US006086488A

United States Patent [19]

Sanders

[11] Patent Number: 6,086,488

[45] Date of Patent: Jul. 11, 2000

[54] BATTING TRAINING SYSTEM

[76] Inventor: Albert J. Sanders, 7363 W. Laraway Rd., Frankfort, Ill. 60423

[21] Appl. No.: 09/208,300

[22] Filed: Dec. 9, 1998

[51] Int. Cl.[7] ..... A63B 69/00

[52] U.S. Cl. ..... 473/423; 473/429

[58] Field of Search ..... 473/415–430, 473/143, 575, 431, 432, 436

[56] References Cited

U.S. PATENT DOCUMENTS

| | | | |
|---|---|---|---|
| 2,527,906 | 10/1950 | Bennett et al. | 473/417 |
| 3,006,647 | 10/1961 | Haskett | 473/429 |
| 4,105,203 | 8/1978 | Cho | 473/429 |
| 4,576,379 | 3/1986 | Juhasz | 473/430 |
| 5,340,101 | 8/1994 | Lawson et al. | 273/26 |
| 5,458,326 | 10/1995 | Marcyes | 273/26 E |
| 5,540,430 | 7/1996 | Nichols et al. | 273/26 E |
| 5,662,537 | 9/1997 | Zuber | 473/426 |
| 5,683,315 | 11/1997 | Ring | 473/429 |
| 5,743,820 | 4/1998 | Espinoa et al. | 473/429 |

*Primary Examiner*—Jeanette Chapman
*Assistant Examiner*—Mitra Aryanpour
*Attorney, Agent, or Firm*—Joseph N. Breaux

[57] ABSTRACT

A batting training system having a ball supported by a tether from a horizontal arm that includes a ball capturing device for capturing the ball after it is struck and preventing the ball from spinning rapidly around the horizontal arm after being struck by a batter.

1 Claim, 2 Drawing Sheets

BATTING TRAINING SYSTEM

TECHNICAL FIELD

The present invention related to sport training aids and devices and more particularly to a batting training system that includes a base assembly, a height adjustable telescoping vertical support assembly, a ball support arm, a tethered target ball, and a ball capture backstop assembly; the base assembly including a central base member having a vertical support attachment fitting and three spaced support leg fittings, a vertical support locking pin, three detachable support legs each having a first leg end sized and shaped to be frictionally insertable into one of the three spaced support leg fittings and a second leg end having a stake receiving aperture formed therethrough, and three support leg securing stakes each having a shaft sized to fit through the stake receiving aperture and a head sized larger than the stake receiving aperture; the height adjustable, telescoping vertical support assembly having cushioned upper and lower telescopically connected support sections and a height locking screw for locking the upper support section in a fixed relationship with the lower support section, the lower support section having a bottom end shaped and sized to fit into the vertical support attachment fitting of the base assembly; the ball support arm extending perpendicularly from the upper support section and having a rotatable ball connecting ring provided at the end thereof; the tethered target ball being suspended from the rotatable ball connecting ring by a flexible tether; the ball capture backstop assembly having two spaced backstop support arms extending perpendicularly from the upper support section at a location above the ball support arm and a loosely supported, flexible ball capture backstop member secured between the two spaced backstop support arms and positioned with respect to the tethered target ball such that the tethered target ball strikes the ball capture backstop member when traveling along an arcuate path defined by the flexible tether.

BACKGROUND ART

Excelling at sports often requires large amounts of practice. This is particularly true of batting in the game of baseball. One practice activity many players find effective is hitting a baseball suspended from a horizontal arm. Although this type of practice can be beneficial, the ball can spin rapidly around the horizontal arm when struck by the bat and can cause injuries when a forgetful player forgets and walks into the ball. It would be a benefit, therefore, to have a batting training system having a ball supported from a horizontal arm that included a ball capturing device for capturing the ball after it is struck and preventing the ball from spinning rapidly around the horizontal arm after being struck by a batter.

GENERAL SUMMARY DISCUSSION OF INVENTION

It is thus an object of the invention to provide a batting training system having a ball supported by a tether from a horizontal arm that includes a ball capturing device for capturing the ball after it is struck and preventing the ball from spinning rapidly around the horizontal arm after being struck by a batter.

It is a further object of the invention to provide a batting training system that includes a base assembly, a height adjustable telescoping vertical support assembly, a ball support arm, a tethered target ball, and a ball capture backstop assembly; the base assembly including a central base member having a vertical support attachment fitting and three spaced support leg fittings, a vertical support locking pin, three detachable support legs each having a first legend sized and shaped to be frictionally insertable into one of the three spaced support leg fittings and a second leg end having a stake receiving aperture formed therethrough, and three support leg securing stakes each having a shaft sized to fit through the stake receiving aperture and a head sized larger than the stake receiving aperture; the height adjustable, telescoping vertical support assembly having cushioned upper and lower telescopically connected support section and a height locking screw for locking the upper support section in a fixed relationship with the lower support section, the lower support section having bottom end shaped and sized to fit into the vertical support attachment fitting of the base assembly; the ball support arm extending perpendicularly from the upper support section and having a rotatable ball connecting ring provided at the end thereof; the tethered target ball being suspended from the rotatable ball connecting ring by a flexible tether; the ball capture backstop assembly having two spaced backstop support arms extending perpendicularly from the upper section at a location above the ball support arm and a loosely supported, flexible ball capture backstop member secured between the two spaced backstop support arms and positioned with respect to the tethered target ball such that the tethered target ball strikes the ball capture backstop member when traveling along an arcuate path defined by the flexible tether.

It is a still further object of the invention to provide a batting training system that accomplishes all or some of the above objects in combination.

Accordingly, a batting training system is provided. The batting training system includes a base assembly, a height adjustable telescoping vertical support assembly, a ball support arm, a tethered target ball, and a ball capture backstop assembly; the base assembly including a central base member having a vertical support attachment fitting and three spaced support leg fittings, a vertical support locking pin, three detachable support legs each having a first leg end sized and shaped to be frictionally insertable into one of the three spaced support leg fittings and a second leg end having a stake receiving aperture formed therethrough, and three support leg securing stakes each having a shaft sized to fit through the stake receiving aperture and a head sized larger than the stake receiving aperture; the height adjustable, telescoping vertical support assembly having cushioned upper and lower telescopically connected support sections and a height locking screw for locking the upper support section in a fixed relationship with the lower support section, the lower support section having a bottom end shaped and sized to fit into the vertical support attachment fitting of the base assembly; the ball support arm extending perpendicularly from the upper support section and having a rotatable ball connecting ring provided at the end thereof; the tethered target ball being suspended from the rotatable ball connecting ring by a flexible tether; the ball capture backstop assembly having two spaced backstop support arms extending perpendicularly from the upper support section at a location above the ball support arm and a loosely supported, flexible ball capture backstop member secured between the two spaced backstop support arms and positioned with respect to the tethered target ball such that the tethered target ball strikes the ball capture backstop member when traveling along an arcuate path defined by the flexible tether.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
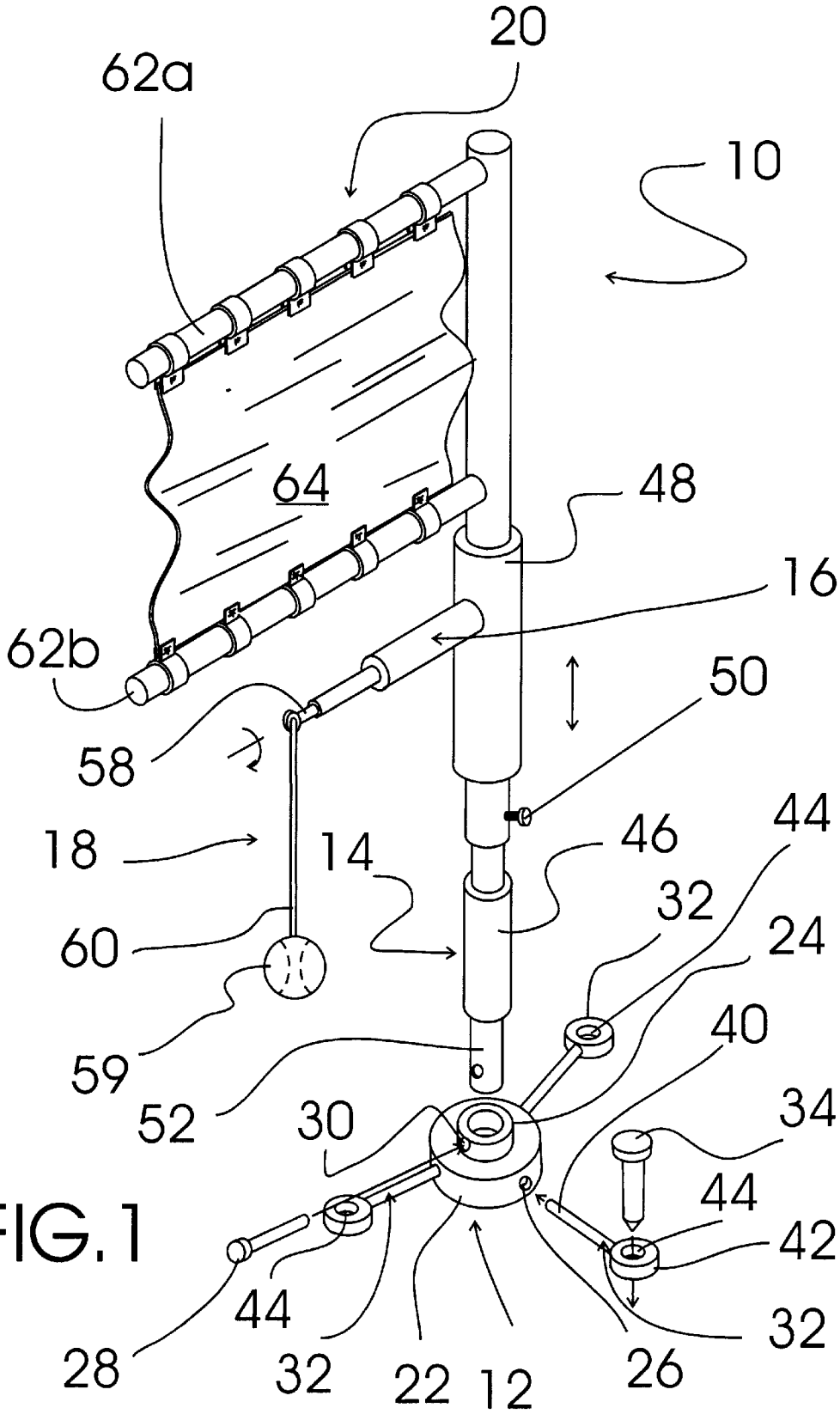
FIG. 1 is a partially exploded perspective view of an exemplary embodiment of the batting training system of the present invention showing the base assembly including the central base member with the vertical support attachment fitting and the three support leg fittings, the vertical support locking pin, the three detachable support legs, and the three support leg securing stakes; the height adjustable, telescoping vertical support assembly with cushioned upper and lower telescopically connected support sections and the height locking screw for locking the upper support section in a fixed relationship with the lower support section; the ball support arm extending perpendicularly from the upper support section and having a rotatable ball connecting ring at the end thereof; the tethered target ball suspended from the rotatable ball connecting ring with a flexible tether; and the ball capture backstop assembly having two spaced backstop support arms extending perpendicularly from the upper support section above the ball support arm and the loosely supported ball capture backstop member secured between the two spaced backstop support arms and positioned with respect to the tethered target ball such that the tethered target ball strikes the ball capture backstop member when traveling along an arcuate path defined by the flexible tether.

FIG. 1 shows an exemplary embodiment of the batting training system of the present invention generally designated 10. Batting training system 10 includes a base assembly, generally designated 12; a height adjustable telescoping vertical support assembly, generally designated 14; a ball support arm, generally designated 16; a tethered target ball, generally designated 18; and a ball capture backstop assembly, generally designated 20. Base assembly 12 includes a central base member 22 having a vertical support attachment fitting 24 and three support leg fittings 25 (only one shown), a vertical support locking pin 28 that fits into a locking pin hole 30 of vertical support attachment fitting 24, three detachable support legs 32, and three support leg securing stakes 34. Each of the three detachable support legs 32 has a first leg end 40 sized and shaped to be frictionally insertable into one of the three spaced support leg fittings 26 and a second leg end 42 having a stake receiving aperture 44 formed therethrough.

Height adjustable, telescoping vertical support assembly 14 has cushioned upper and lower telescopically connected support sections 46, 48 and a height locking screw 50 for locking upper support section 48 in a fixed relationship with lower support section 46. Lower support section 46 has a bottom end 52 shaped and sized to fit into vertical support attachment fitting 24 of base assembly 12. Ball support arm 16 extends perpendicularly from upper support section 48 and has a rotatable ball connecting ring 58 provided at the end thereof. Tethered target ball 18 includes a ball 59 suspended from rotatable ball connecting ring 58 by a flexible tether 60.

Figure 2:
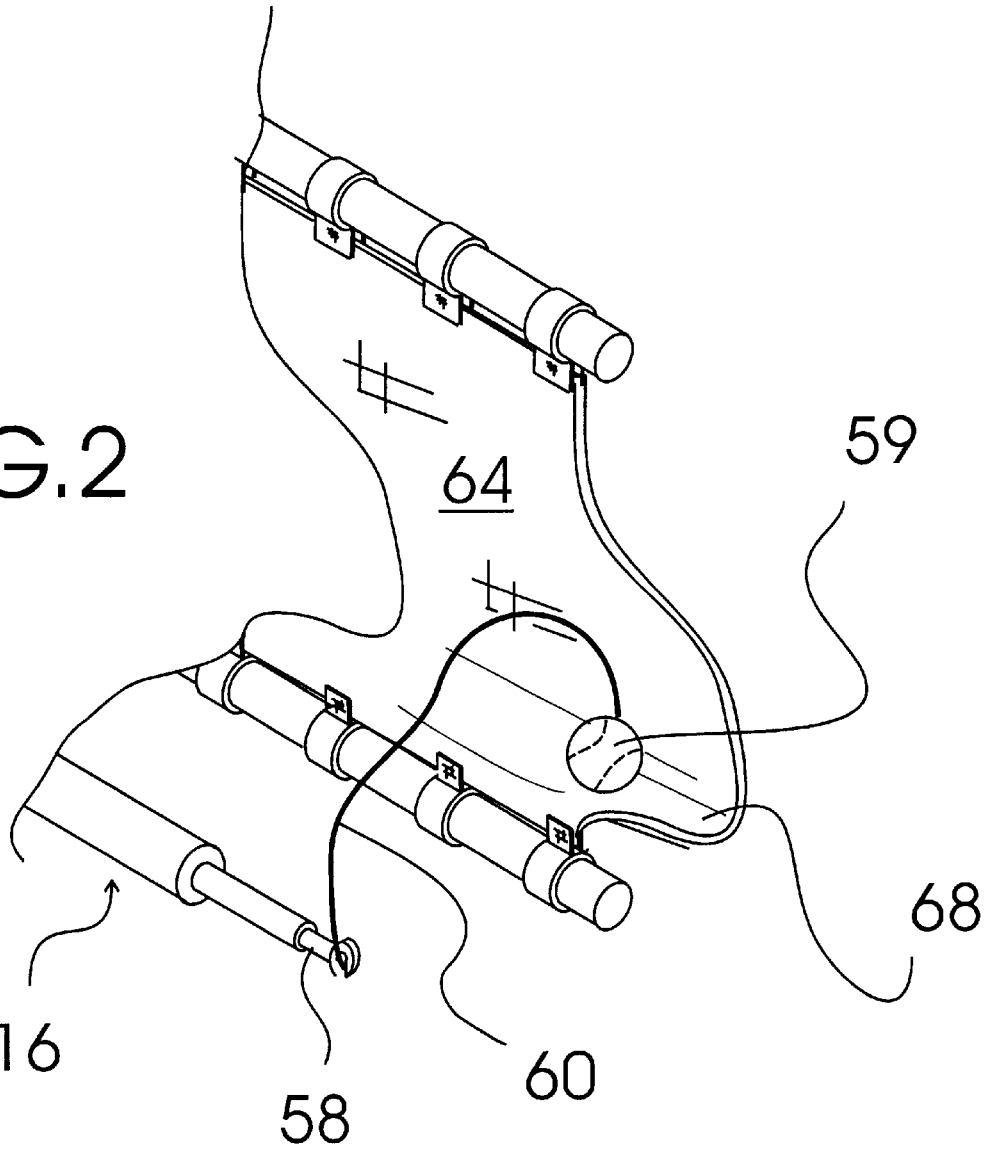
FIG. 2 is a detail perspective view showing the tethered target ball caught within the ball capture backstop member.

Ball capture backstop assembly 20 has two spaced backstop support arms 62*a*, 62*b* extending perpendicularly from upper support section 48 at a location above ball support arm 16. A flexible, nylon fabric, ball capture backstop member 64 is loosely supported between spaced backstop support arms 62*a*, 62*b* . With reference to FIG. 2, flexible ball capture backstop member 64 is positioned with respect to ball 59 of tethered target ball 18 such that ball 59 strikes loosely supported ball capture backstop member 64 when traveling along an arcuate path defined by flexible tether 60. Ball capture backstop member 64 is supported sufficiently loosely to form a holding channel 68 within which ball 59 falls after striking ball capture backstop member 64. The player can then push ball 59 out of holding channel 68 by pushing with the top of the bat.

It can be seen from the preceding description that a batting training system having a ball supported by a tether from a horizontal arm has been provided that includes a ball capturing device for capturing the ball after it is struck and preventing the ball from spinning rapidly around the horizontal arm after being struck by a batter and that includes a base assembly, a height adjustable telescoping vertical support assembly, a ball support arm, a tethered target ball, and a ball capture backstop assembly; the base assembly including a central base member having a vertical support attachment fitting and three spaced support leg fittings, a vertical support locking pin, three detachable support legs each having a first leg end sized and shaped to be frictionally insertable into one of the three spaced support leg fittings and a second leg end having a stake receiving aperture formed therethrough, and three support leg securing stakes each having a shaft sized to fit through the stake receiving aperture and a head sized larger than the stake receiving aperture; the height adjustable, telescoping vertical support assembly having cushioned upper and lower telescopically connected support sections and a height locking screw for locking the upper support section in fixed relationship with the lower support section, the lower support section having a bottom end shaped and sized to fit into the vertical support attachment fitting of the base assembly; the ball support arm extending perpendicularly from the upper support section and having a rotatable ball connecting ring provided at the end thereof; the tethered target ball being suspended from the rotatable ball connecting ring by a flexible tether the ball capture backstop assembly having two spaced backstop support arms extending perpendicularly from the upper support section at a location above the ball support arm and a loosely supported, flexible ball capture backstop member secured between the two spaced backstop support arms and positioned with respect to the tethered target ball such that the tethered target ball strikes the ball capture backstop member when traveling along an arcuate path defined by the flexible tether.

It is noted that the embodiment of the batting training system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirement of the law, it is to be understood that the details herein are to be interpreted as illustrative and not in a limiting sense.

What is claimed is:

1. A batting training system comprising:

a base assembly;

a height adjustable telescoping vertical support assembly;

a ball support arm;

a tethered target ball; and a ball capture backstop assembly;

said base assembly including a central base member having a vertical support attachment fitting and three spaced support leg fittings, a vertical support locking pin, three detachable support legs each having a first leg end sized and shaped to be frictionally insertable into one of said three spaced support leg fittings and a second leg end having a stake receiving aperture formed therethrough, and three support leg securing stakes each having a shaft sized to fit through said stake receiving aperture and a head sized larger than said stake receiving aperture;

said height adjustable, telescoping vertical support assembly having cushioned upper and lower telescopically connected support sections and a height locking screw for locking said upper support section in a fixed relationship with said lower support section, said lower support section having a bottom end shaped and sized to fit into said vertical support attachment fitting of said base assembly;

said ball support arm extending perpendicularly from said upper support section and having a rotatable ball connecting ring provided at said end thereof;

said tethered target ball being suspended from said rotatable ball connecting ring by a flexible tether;

said ball capture backstop assembly having two spaced backstop support arms extending perpendicularly from said upper support section at a location above said ball support arm and a loosely supported, flexible ball capture backstop member secured between said two spaced backstop support arms to form a holding channel and positioned with respect to said tethered target ball such that said tethered target ball strikes and is captured by said holding channel of said ball capture backstop member when traveling along an arcuate path defined by said flexible tether.

* * * * *